United States Patent [19]

Chibana et al.

[11] 3,992,970

[45] Nov. 23, 1976

[54] ELECTRONIC MUSICAL INSTRUMENT

[75] Inventors: Masanobu Chibana; Tsuyoshi Futamase, both of Hamamatsu, Japan

[73] Assignee: Nippon Gakki Seizo Kabushiki Kaisha, Japan

[22] Filed: Nov. 11, 1975

[21] Appl. No.: 630,862

[30] Foreign Application Priority Data

Nov. 15, 1974 Japan ..... 49-131781

[52] U.S. Cl. ..... 84/1.11; 84/1.03; 84/1.19; 84/1.22; 84/1.23

[51] Int. Cl.[2] ..... G10F 1/00

[58] Field of Search ..... 84/1.01, 1.03, 1.11, 84/1.19, 1.22, 1.24, DIG. 4, 1.23

[56] References Cited

UNITED STATES PATENTS

| | | | |
|---|---|---|---|
| 3,809,786 | 5/1974 | Deutsch | 84/1.03 X |
| 3,809,788 | 5/1974 | Deutsch | 84/1.03 X |
| 3,809,790 | 5/1974 | Deutsch | 84/1.01 |
| 3,809,792 | 5/1974 | Deutsch | 84/1.24 |
| 3,910,150 | 10/1975 | Deutsch et al. | 84/1.03 |

*Primary Examiner*—Ulysses Weldon
*Attorney, Agent, or Firm*—Ladas, Parry, Von Gehr, Goldsmith & Deschamps

[57] ABSTRACT

An electronic musical instrument capable of producing any desired combination of two tones of mutually different footage. According to the invention, such combination of tones can be produced from only two tone sources without providing tone sources of an equal number to a total number of footage to be coupled. In view of the fact that musical tone waveshape amplitudes of two coupled tones of different footage can be represented by a multiplication term of a sine wave content and a cosine wave content, these two waveshape contents are individually calculated and then combined to form amplitudes of a composite musical tone waveshape.

6 Claims, 2 Drawing Figures

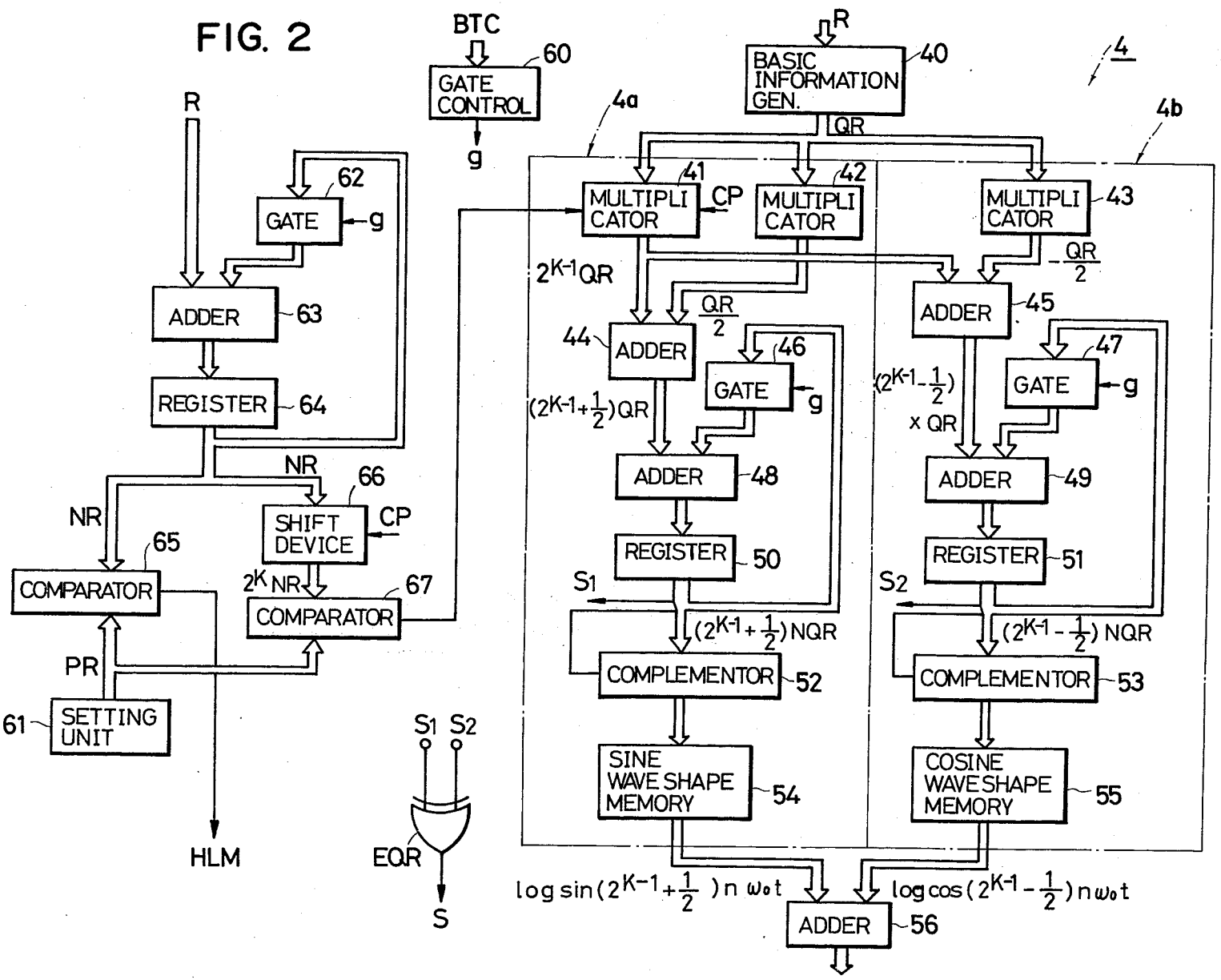
FIG. 2
4
4a
4b
R
BASIC INFORMATION GEN.
40
QR
BTC
GATE CONTROL
60
g
MULTIPLI CATOR
41
42
43
CP
$2^{K-1}$QR
$\frac{QR}{2}$
$-\frac{QR}{2}$
ADDER
44
45
$(2^{K-1}+\frac{1}{2})$QR
$(2^{K-1}-\frac{1}{2})$ x QR
GATE
46
47
ADDER
48
49
REGISTER
50
51
S1
S2
$(2^{K-1}+\frac{1}{2})$NQR
$(2^{K-1}-\frac{1}{2})$NQR
COMPLEMENTOR
52
53
SINE WAVE SHAPE MEMORY
54
COSINE WAVE SHAPE MEMORY
55
$\log \sin(2^{K-1}+\frac{1}{2})n\omega_0 t$
$\log \cos(2^{K-1}-\frac{1}{2})n\omega_0 t$
ADDER
56
S1 S2
EQR
S
GATE
62
ADDER
63
REGISTER
64
NR
SHIFT DEVICE
66
$2^K$NR
COMPARATOR
67
HLM
COMPARATOR
65
PR
SETTING UNIT
61

ELECTRONIC MUSICAL INSTRUMENT

BACKGROUND OF THE INVENTION

This invention relates to an electronic musical instrument capable of producing a coupler effect derived from simultaneous playing of plural tones of different footage.

For producing two tones of different footage by single depression of key, a prior art electronic musical instrument had to have tone source devices for respective footage. If coupled tones such as a combination of an 8-foot register tone and a 4-foot register tone, a combination of an 8-foot register tone and a 2-foot register tone, and a combination of a 8-foot register tone and a 16-foot register tone are to be obtained, tone source devices for the respective footage had to be provided. This naturally resulted in a bulky and complicated construction and a high cost of manufacture.

SUMMARY OF THE INVENTION

It is, therefore, an object of the invention to provide an electronic musical instrument capable of producing the coupler effect with a simplified construction.

According to the invention, musical tone waveshape amplitudes of two coupled tones of different footage are calculated as a single multiplication term containing two waveshape contents, and the two waveshape contents are substantially calculated in a logarithmic form. This contributes to simplification of the instrument. On the other hand, various coupled footage can be produced from only two tone sources by using footage to be coupled to a basic footage as a variable.

It is another object of the invention to provide an electronic musical instrument including a harmonic inhibit device for preventing noise caused by a folding frequency.

The basic principle of the present invention will now be described.

According to the invention, an octave coupler effect is achieved by carrying out the following formula:

$$Zc = \sin n\,\omega_o t + \sin 2^k\, n\omega_o t \qquad (1)$$

where $\omega_o$ represents angular velocity of fundamental frequency, $n$ degree of harmonic, $t$ time, $2^k$ coefficient corresponding to a coupled footage in octave relationship in which $k$ is an integer: and $Zc$ instantaneous value of waveshape at the time $t$ (i.e. phase) of the harmonic waveshape of the degree $n$. The term $\sin n\,\omega_o t$ is a sine function of the respective harmonics (including a fundamental wave) of a basic footage and $2^k$ corresponds to a number of footage to be coupled with the basic footage. If, for example, the basic footage is 8 feet, the number of footage will be 4 feet when $k = 1$ and 16 feet when $k = -1$. Accordingly, various octave coupler effects can be produced by varying $k$.

The above formula (1) can also be expressed by the following formula (2) having a single multiplication term:

$$Zc = 2 \sin (2^{k-1} + ½)\, n\,\omega_o t \cos (2^{k-1} - ½)\, n\omega_o t \qquad (2)$$

That is, the single multiplication term consists of two waveshape components, i.e. a sine waveshape component and a cosine waveshape component and this can readily be converted to the following logarithmically expressed formula (3):

$$\log Zc = \log 2 + \log \sin (2^{k-1} + ½)\, n\omega_o t + \log \cos \{(2^{k-1} - ½)\, x\, n\omega_o t\} \qquad (3)$$

According to this formula (3), the multiplication portion of the formula is substituted by an addition portion. This will greatly contribute to simplification of construction of a calculating device used in a digital type apparatus.

Furthermore, the present invention is capable of coupling tones of footage which are not in octave relationship to each other. In this case, the variable $2^k$ corresponding to footage in the formula (1) is substituted by any desired positive number (relational number) $m$. The fundamental formula (1) is thereby transformed into $$Zc = \sin n\,\omega_o t + \sin m\,n\,\omega_o t = 2 \sin \left(\frac{m}{2} + \frac{1}{2}\right) n\,\omega_o t \cos \left(\frac{m}{2} - \frac{1}{2}\right) n\,\omega_o t \qquad (4)$$

This formula (4) is further transformed into the following logarithmically expressed formula (5):

$$\log Zc = \log 2 + \log \sin \left(\frac{m}{2} + \frac{1}{2}\right) n\,\omega_o t + \log \cos \left(\frac{m}{2} - \frac{1}{2}\right) n\,\omega_o t \qquad (5)$$

If, for example, the basic footage is 8 feet and $m$ is 3, the number of footage to be coupled with the basic footage is 2⅔ feet. If $m$ is 1, the number of footage becomes the same as the basic footage with a result that no coupler effect is produced.

The invention will now be described with reference to the accompanying drawings.

BRIEF DESCRIPTION OF THE DRAWINGS

FIG. 2 is a block diagram showing an essential part of the embodiment.

DETAILED DESCRIPTION OF A PREFERRED EMBODIMENT

Figure 1:
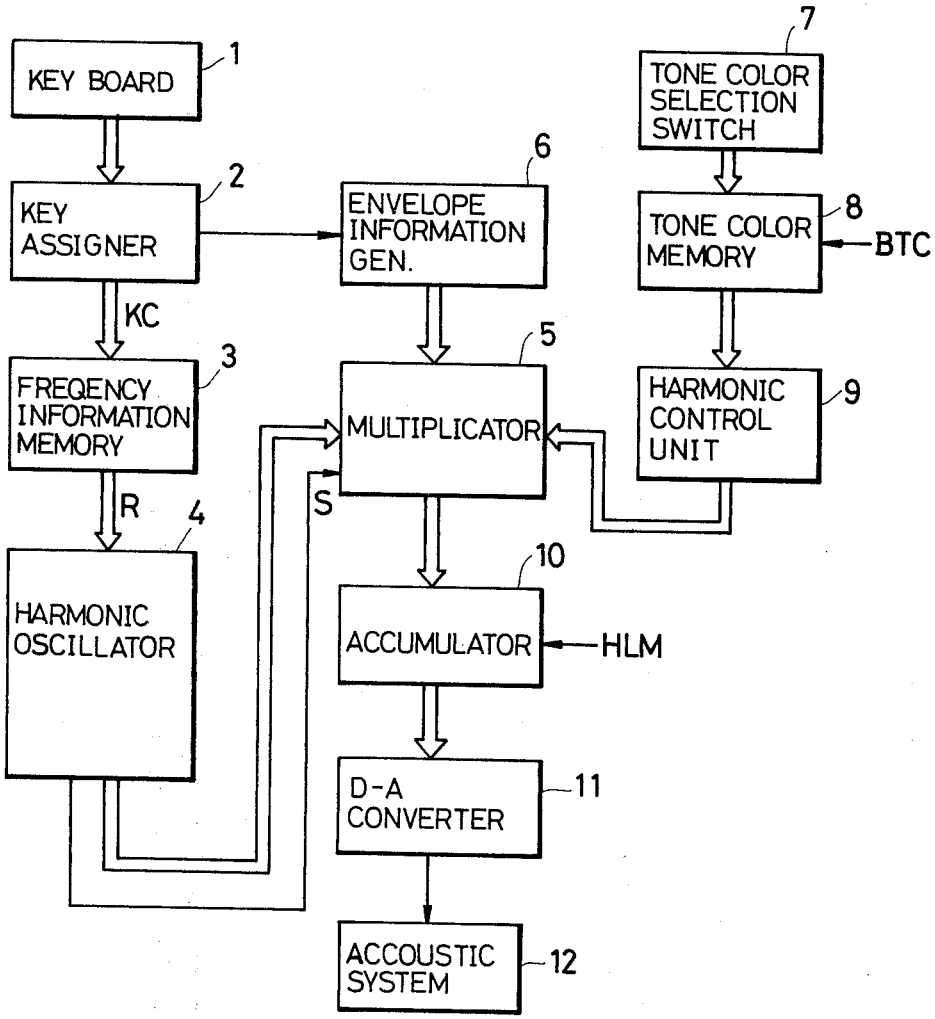
FIG. 1 is a block diagram schematically showing a preferred embodiment of the electronic musical instrument according to the invention.

FIG. 1 is a block diagram schematically showing an entire construction of the electronic musical instrument according to the invention. The basic concept of the entire construction is to calculate amplitude values of respective harmonics of a musical tone waveshape to be reproduced at respective sample points with a regular time interval, multiply the amplitude values with amplitude coefficients of the respective harmonics characterizing the tone color of the musical tone and thereafter cumulatively add all the harmonic contents to form the desired musical tone waveshape. This basic construction has already been described in a copending U.S. patent application Ser. No. 225,883, now U.S. Pat. No. 3,809,786, so that detailed description of the entire construction will be omitted and a harmonic oscillator 4 which constitutes an important feature of the present invention will be described in detail.

A key assigner 2 produces key address codes KC representing the key names of depressed keys in response to key-on information supplied from a keyboard circuit 1. These key address codes KC are allotted in a time sharing manner to respective channels corresponding to a maximum number of tones to be reproduced simultaneously and are read out sequentially at each channel time.

The key assigner 2 also produces various clock pulses or time-shared information used for controlling time-shared synchronized operation of respective units constituting the instrument. Assume, for example, that the inventive electronic musical instrument uses higher harmonics up to the eighth harmonic and that a maximum number of tones to be reproduced simultaneously is eight. Clock pulses are counted by a first counter of eight stages (not shown) to form time sharing time slots for each harmonics and the frequency divided output of this counter is further counted by a second counter of eight stages (not shown) to form time sharing time slots for each of channels corresponding in number to the maximum number of tones to be reproduced simultaneously. The output of the first counter is hereinafter referred to as a degree-of-harmonic signal BTC. This signal BTC is utilized for forming regular time interval of calculation required to produce the respective harmonic contents as will be described later.

A frequency information memory 3 previously stores frequency information R which is a value proportionate to the frequency of each tone of the basic footage. Frequency information R corresponding to the depressed key is read out in response to contents of key address code KC.

A harmonic oscillator 4 produces in a time sharing manner amplitudes at each phase of desired sine and cosine waves in accordance with the fundamental formula for achieving the coupler effect such as the formula (3) or (5). FIG. 2 shows a specific example of such harmonic oscillator adapted to achieve the coupler effect as expressed by the formula (3).

A basic information generator 40 cumulatively counts with a certain interval (e.g. every 8 channel times) frequency information R read out in time sharing from the frequency information memory 3 at each channel time thereby forming basic information QR($Q = 1, 2, 3 \ldots$) to be used for producing harmonic information. The phase of the fundamental wave is determined by this basic information. That is, the basic information QR corresponds to the phase $\omega_o t$. The basic information QR is generated in time sharing with respect to the eight tones (i.e. at each channel time).

The output QR of the basic information generator 40 is applied to harmonic calculators 4*a*, 4*b*. The first harmonic calculator 4*a* performs calculation corresponding to the term of the logarithmically expressed sine wave, i.e. log sin $(2^{k-1} + ½)\, n\, \omega_o t$ in the formula (3) and produces respective harmonic amplitudes of the first to the eighth degree of sine wave function content. The second harmonic calculator 4*b* performs calculation corresponding to the term of the logarithmically expressed cosine wave, i.e. log cos $(2^{k-1} - ½)\, n\, \omega_o t$ in the formula (3) and produces respective harmonic amplitudes of the first to the eighth degree of the cosine wave function content.

The basic information QR is applied to multiplicators 41, 42 and 43. The multiplicator 41 multiplies the basic information QR by $2^{k-1}$ to obtain a product $2^{k-1}$QR (i.e. information corresponding to $2^{k-1}\,\omega_o t$). Since multiplier to QR is a k−1-th power of 2, a simple shift device can be used as the multiplicator 41. Coupler control information CP is a value corresponding to the variable K. The variable K is changed by suitably setting the information CP to variably control relationship of the coupled footage in the octave coupler effect. The information $2^{k-1}$QR is applied to adders 44, 45 of the harmonic calculators 4*a*, 4*b*. The multiplicator 42 multiplies the basic information QR by ½ to obtain a product of QR/2 (i.e. information corresponding to $½\omega_o t$). The multiplicator 42 can be constructed of a simple shift device which produces $QR/_2$ by shifting the information QR by one digit towards less significant bits.

The multiplicator 43 multiplies the basic information QR by −½ to obtain information −QR/2 corresponding to $-½\omega_o t$. This multiplicator 43 may also be constructed of a simple shift device in which the information QR is shifted by one digit towards less significant digits the thereafter is inverted to form information of a negative sign.

The adder 44 adds the information $2^{k-1}$QR and QR/2 together to produce information $(2^{k-1} + ½)$QR corresponding to $(2^{k-1} + ½)\,\omega_o t$, whereas the adder 45 adds the information $2^{k-1}$QR and − QR/2 corresponding to $(2^{k-1} - ½)\,\omega_o t$. The output of the adder 44 is applied to the calculator which consists of a gate circuit 46, an adder 48 and a register 50. The output of the adder 45 is applied to the calculator which consists of a gate circuit 47, an adder 49, a register 51. The information applied to these calculators is cumulatively counted at each harmonic calculation time (i.e. timing of the degree-of-harmonic signal BTC) to provide harmonic information $(2^{k-1} + ½)$NQR and $(2^{k-1} - ½)$NQR ($N = 1, 2 \ldots 8$). Amplitudes at respective sample points of the sine and cosine waveshapes respectively stored in a sine waveshape memory 54 and cosine waveshape memory 55 are read out in response to the harmonic information $(2^{k-1} + ½)$NQR and $(2^{k-1} - ½)$NQR. The memories 54, 55 store the amplitudes at the respective sample points in a logarithmic form.

For calculating the amplitudes of the respective harmonics with a regular time interval, a gate control unit 60 produces, upon receipt of the signal BTC, a gate control pulse *g* with an interval corresponding to calculation time of the respective harmonics. The results of addition temporarily held in registers 50, 51 are applied to one input of adders 48, 49 through gate circuits 46, 47 which are enabled with the interval of the gate control pulse *g*. The information $(2^{k-1} + ½)$QR and $(2^{k-1} - ½)$QR is applied to another input of the adders 48, 49. This information is constant during one channel time. Accordingly, the gate circuits 46, 47 are enabled sequentially with the timing of the pulse *g* during one channel time to enable the cumulative addition with a result that the harmonic information from the first to the eighth (*n*th) degrees is sequentially produced. Upon completion of one channel time (i.e. upon completion of the cumulative addition of all the harmonics), the gate control pulse *g* is no longer generated.

In a next channel time, cumulative addition of different basic information QR is performed in the adders 48, 49.

The sine waveshape memory 54 and the cosine waveshape memory 55 digitally store logarithmically expressed information of amplitudes at respective sample points of a quarter cycle of sine and cosine waveshapes. On the other hand, the cumulative addition by the basic information generator 40, adders 48, 49, registers 50, 51 and gate circuits 46, 47 is made until the information has amounted to a phase of one cycle $2\pi$. That is, the information returns to 0 every time it has mounted to a value corresponding to one cycle and the cumulative counting is repeated. Accordingly, distinction between a former half cycle (0) and a latter half cycle (1) of a waveshape is made in accordance with contents (0 or 1) of the most significant bit of the information held in the registers 50, 51. This information of the most significant bit is hereinafter referred to as a sign signals $S_1$, $S_2$. Further, distinction between a first quarter cycle (0) and a second quarter cycle (1) can be made in accordance with contents (0 or 1 ) of a bit which is one digit less significant than the most significant bit. For this purpose, the signal of this bit one digit less significant than the most significant bit is applied to a control input of complementors 52, 53 and the results of cumulative addition of the contents of digits which are less significant than this bit signal are applied to the complementors 52, 53. When the control input signal of the complementors 52, 53 is 0, the harmonic information from the registers 50, 51 is directly applied to the waveshape memories 54, 55 to be used as address for reading out a quarter cycle of the logarithmically expressed waveshapes. When the control input signal is 1, complements of the respective harmonic information from the registers 50, 51 are obtained and the information of such complements is used as address for reversely reading out the stored first quarter cycle of the waveshape amplitudes thereby to produce amplitudes forming a next quarter cycle of the waveshapes. The logarithmically expressed sine waveshape amplitude information log sin $(2^{k-1}+\frac{1}{2})n\omega_o t$ and the cosine waveshape amplitude information log soc $(2^{k-1}-\frac{1}{2})n\omega_o t$ can be substantially obtained in the foregoing manner. Actually, the amplitude corresponding to the former half cycle of the waveshape are repeatedly read out and the sign is inverted in the latter half cycle in a harmonic coefficient multiplicator 5 to be described later in accordance with the sign signals $S_1$, $S_2$ for producing a normal waveshape. The sign signals $S_1$, $S_2$ are combined in an exclusive OR circuit EOR and the combined sign signal S is applied to the harmonic coefficient multiplicator 5.

The amplitude information read from the waveshape memories 54, 55 which is synchronous with each other by each degree of harmonic is applied simultaneously to an adder 56 at each harmonic time. The adder 56 performs addition of log sin $(2^{k-1}+\frac{1}{2})n\omega_o t$ + log cos $(2^{k-1}-\frac{1}{2})n\omega_o t$. The result of addition constitutes a composite amplitude of coupled tones of different footage for achieving the octave coupler effect. This composite amplitude is supplied to the harmonic coefficient multiplicator 5.

In order to prevent occurence of noise due to a folded frequency, a harmonic inhibit device is provided. A setting unit 61 sets information corresponding to a frequency which is half the sampling frequency (e.g. 15 $KH_2$). The frequency information R is cumulatively added in an accumulator consisting of a gate circuit 62, an adder 63 and a register 64 timing of the pulse *g*. Information NR for each degree of harmonic obtained by this cumulative addition is compared with the set information PR in a comparator 65 which produces a harmonic inhibit signal HLM during the particular harmonic time if NR>PR to control other units of the instrument for preventing generation of harmonic content of the particular degree. This control is effected by, for example, excluding the harmonic content of the particular degree from cumulative addition in an accumulator 10. Since the harmonic content of the particular degree contains two tones of different footage, all noise can be prevented by the signal HLM only if the coupled footage is longer than the basic footage (because the information R corresponds to the basic footage). If, however, the coupled footage is shorter than the basic footage (i.e. in case K is a value over 1), there arises possibility that generation of harmonic content due to the short coupled footage is not prevented. To cope with this problem, the accumulated information NR is applied to a shift device 66 where it is shifted by $2^k$ corresponding to the footage to be coupled with the basic footage to produce accumulated information corresponding to the coupled footage. The coupler control information CP also is applied to this shift device 66 to change the variable K as desired. A comparator 67 compares the accumulated information $2^k$NR with the set information PR and provides the multiplier 41 with a shift signal when $2^k$NR is greater than PR.

If the coupled foot tone is higher than the basic foot tone, the comparator 67 provides output in precedence to the comparator 65. The multiplicator 41 produces an output QR/2 when the shift signal is applied to the comparator 67. The result of addition in the adder 44 thereby becomes QR and the result of addition in the adder 45 becomes 0. Accordingly, no waveshape amplitude is read from the cosine waveshape memory 55, whereas the amplitude log sin $n\omega_o$ corresponding to the basic foot tone is read from the waveshape memory 54. In this manner, harmonic content of high coupled foot tone which is likely to generate noise is successfully prevented. If production of the coupler effect is not desired, the basic foot tone only is produced by setting the control signal CP at 0 for the same reason as stated above.

In FIG. 1, an envelope information generator 6 generates in a time sharing manner envelope control information including attack, decay, sustain and release by each of the tones to be reproduced simultaneously, (i.e. every channel time) in response to the key-on and key-off information from the key assigner 2. This envelope control information may conveniently be expressed in a logarithmic form.

A tone color memory 8 previously stores amplitude coefficient (level information) of the respective harmonic contents realizing various tone colors and provides, in response to the degree-of-harmonic signal BTC, amplitude coefficient (level) information of harmonic contents corresponding to a tone color selected by operation of a tone color selection switch 7 in time shared sequence by each of the harmonics. A harmonic control unit 9 performs control functions including modulation of the read out coefficient information of the respective harmonics and selection of the coefficient information for obtaining different tone colors according to the kind of keyboard, supplying in time sharing the coefficient information of the respective harmonics (including a fundamental wave) to the multiplicator 5. This amplitude coefficient information also may conveniently be expressed in a logarithmic form.

In the harmonic coefficient multiplicator 5, the envelope control information for controlling the entire level of a certain tone and amplitude coefficient information of the harmonics of the respective degrees for realizing a desired tone color is multiplied with composite waveshape amplitude information of the tones of respective footage supplied from the harmonic oscillator 4, i.e. log sin $(2^{k-1} + ½)n\omega_o t$ + log cos $\{(2^{k-1} - ½)\ n\omega_o t\}$. If the respective information is expressed in a logarithmic form, the multiplication is substituted by addition. Thus, waveshape amplitude information characterized in its tone color and envelope is produced in time sharing for each harmonic content. The logarithmically expressed information is converted to linear information in the multiplicator 5. Further, since the information of the half cycle waveshape is not inverted yet, the amplitude information which has now been converted to linear information is inverted in response to the sign signal S to form perfect waveshape amplitude information. Since log 2 in the formula (3) is a constant and contributes only to increasing the amount of attenuation, this is not included in calculation in the multiplicator 5.

The waveshape amplitude information of the respective harmonics produced in this manner is applied to an accumulator 10. The accumulator 10 adds the waveshape amplitude information from the fundamental wave to the eighth ($n$th) harmonic together to produce a single musical tone waveshape amplitude. If desired, amplitudes of the respective tones may be added together by the kind of keyboard. The musical tone waveshape amplitude information of the composite harmonic contents is applied to a digital-analog converter 11 where it is converted to an analog waveshape signal and thereafter is sounded through an acoustic system 12.

In the above described embodiment, the octave coupler effect has been described. It will be appreciated, however, that a coupler effect between tones of different footage which are not in an octave relation may be produced by a similar construction. More specifically, such effect can be obtained by substituting the multiplicator 41 for producing $2^{k-1}$QR by a multiplicator capable of producing $(m/2)$QR and providing value corresponding to the variable $m$ as the coupler control information CP. In this case, the shift device 66 will also be slightly modified.

What is claimed is:

1. An electronic musical instrument of a type wherein amplitudes at sequential sample points of a musical tone waveshape are calculated by sequentially calculating amplitudes of respective harmonic contents at each of the sample points with a regular time interval in accordance with basic information (where R represents frequency information and $Q = 1, 2, 3 \ldots$) and thereafter cumulatively adding the amplitudes of the respective harmonic contents comprising:

a first harmonic calculator for sequentially counting, with said regular time interval, amplitudes of respective harmonic contents of a first waveshape content of a composite musical tone waveshape composed of two tones of different footage and represented by a single multiplication term of a sine waveshape content and a cosine waveshape content to produce logarithmically expressed information corresponding to said amplitudes of respective harmonics of the first waveshape content;

a second harmonic calculator for sequentially counting, with said regular time interval, amplitudes of respective harmonic contents of a second waveshape content of said composite musical tone waveshape to produce logarithmically expressed information corresponding to said amplitudes of respective harmonics of the second waveshape content means for sequentially synthesizing said logarithmically expressed information of respective harmonic content amplitude of said first and second waveshape contents;

composite amplitudes of said first and second waveshape contents by each degree of harmonic being sequentially produced with said regular time interval and said composite amplitudes being cumulatively added for producing composite musical tone waveshape amplitudes of the coupled tones of different footage.

2. An electronic musical instrument as defined in claim 1 wherein said first harmonic calculator calculates log sin $(2^{k-1} + ½)n\omega_o t$ (where $n$ represents degree of harmonic, $\omega_o$ angular velocity of the fundamental wave and $K$ a constant which determines footage to be coupled with basic footage), and said second harmonic calculator calculates log cos $(2^{k-1} - ½)n\omega_o t$.

3. An electronic musical instrument as defined in claim 2 wherein said first harmonic calculator comprises a first multiplicator for multiplying information QR corresponding to the phase $\omega_o t$ with the constant $2^{k-1}$, a second multiplicator for multiplying the information QR with ½, an adder for adding the outputs of said first and second multiplicators together, an accumulator for cumulatively adding the outputs from said adder at each harmonic calculation time and a sine waveshape memory which stores a sine waveshape and is addressed by the output of said accumulator to provide amplitudes of the sine waveshape at sample points corresponding to the outputs of said accumulator, and said second harmonic calculator comprises a multiplicator for multiplying information QR with ½, an adder for adding the outputs of this multiplicator and said first multiplicator together, an accumulator for cumulatively adding the outputs from said adder at each harmonic calculation time and a cosine waveshape memory which stores a cosine waveshape and is addressed by the output of said accumulator to provide amplitudes of the cosine waveshape at sample points corresponding to the outputs of said accumulator.

4. An electronic musical instrument as defined in claim 1 further comprising a harmonic inhibit device for preventing occurence of noise due to a folding frequency.

5. An electronic musical instrument as defined in claim 4 wherein said harmonic inhibit device comprises a setting unit for setting information P corresponding to a frequency which is half the sampling frequency, an accumulator for cumulatively adding the frequency information R at each harmonic calculation time and means for comparing the output of said accumulator with the information PR to produce a harmonic inhibit signal when NR is greater than PR.

6. An electronic musical instrument as defined in claim 5 wherein said harmonic inhibit device further comprises a shift device for shifting the output NR of said accumulator by $2^k$ which corresponds to the footage to be coupled with the basic footage to produce information $2^k$NR and means for comparing the information $2^k$NR with the information PR to produce a harmonic inhibit signal when $2^k$NR is greater than PR.

* * * * *